United States Patent [19]

Massott et al.

[11] Patent Number: 4,610,367

[45] Date of Patent: Sep. 9, 1986

[54] TAMPER-PROOF CLOSURE

[75] Inventors: Philipp Massott, Neckargemünd; Heinz Leonhardt, Bedburg, both of Fed. Rep. of Germany

[73] Assignee: Vaw-Folien-Verarbeitung GmbH, Fed. Rep. of Germany

[21] Appl. No.: 711,301

[22] Filed: Mar. 13, 1985

[30] Foreign Application Priority Data

Mar. 13, 1984 [EP] European Pat. Off. ..... 84102724.6

[51] Int. Cl.[4] ..... B65D 41/34

[52] U.S. Cl. ..... 215/252; 215/274

[58] Field of Search ..... 215/252, 274

[56] References Cited

U.S. PATENT DOCUMENTS

| | | | |
|---|---|---|---|
| 1,311,419 | 7/1919 | Russell | 215/274 |
| 2,062,271 | 11/1936 | Merolle | 215/274 |
| 3,693,820 | 9/1972 | Linkletter | 215/274 X |
| 3,930,588 | 1/1976 | Coursaut | 215/252 |
| 4,227,618 | 10/1980 | Zipper | 215/274 |
| 4,519,516 | 5/1985 | Amos | 215/274 X |

*Primary Examiner*—Donald F. Norton

*Attorney, Agent, or Firm*—Darby & Darby

[57] ABSTRACT

A circular tamper-proof closure device and process for sealing threaded bottles, jars, and similar containers are disclosed. The closure comprises a sealing ring containing a peripheral lip, a wedge-shaped security ring, retaining bridges to join the sealing ring to the security ring, an annular stop to limit the movement of the security ring, and a metallic cap with a rim that is wedged into the sealing ring between the lip and the security ring. The closure is fastened to the threaded bottle by securing the sealing ring to the bottle and forming threads on the metallic cap.

4 Claims, 3 Drawing Figures

TAMPER-PROOF CLOSURE

This invention relates to tamper-proof metallic closures and a process for applying such closures to threaded containers.

BACKGROUND OF THE INVENTION

Tamper-proof metallic enclosures for bottles, jars, or similar containers, are known in the prior art. One popular closure is the one used on soda and beer bottles. These closures are made entirely from metal and may consist of a sealing cap and a security ring with failure zones (the latter being indentations or impressions in the ring). Upon turning the closure cap, the securing ring is detached at the failure line and remains on the container neck.

A second type of closure cap has clamps on its bottom rim to seal the container. These clamps pry open when the closure is unscrewed from the container.

In a third type of tamper-proof closure, a metal cap is covered with plastic which is then shrunk around the closure. This plastic is ripped when opening the cap.

A fourth type of closure contains a metal cap with an interior security ring of plastic. This plastic ring forms a seal around the bottle neck when the cap is closed and must be torn or otherwise mutilated to open the closure.

All of these closures have drawbacks. Removal of the cap of the first closure leaves the securing ring on the bottle. This ring is difficult to remove afterwards. The second closure cap contains sharp edges after its removal. This cap can therefore cause injuries. The third type of closure involves a complicated and time-consuming capping process making it inefficient and expensive. The fourth closure leaves the plastic ring in the unscrewed cap preventing the cap from being readily recycled.

It is an object of this invention to provide a tamper-proof cap closure which includes none of the foregoing drawbacks.

SUMMARY OF THE INVENTION

In accordance with the illustrative embodiment demonstrating the features of the present invention, there is provided a circular plastic sealing ring comprising a collar having a downwardly extending annular stop integrally formed with the collar. An inwardly protruding peripheral lip extends from the upper surface of the collar. A security ring having a diameter smaller than that of the collar is attached to the inner surface of the collar by a plurality of fracturable retaining bridges. The outward movement of the security ring is limited by the annular stop. The closure is formed by inserting a conventional metal cap including a rolled rim into the gap between the security ring and the peripheral lip. The closure is fastened to the threaded bottles, jars or similar containers by securing the sealing ring to the bottle and forming threads on the metallic cap.

THE DRAWINGS

DETAILED DESCRIPTION

Figure 1:
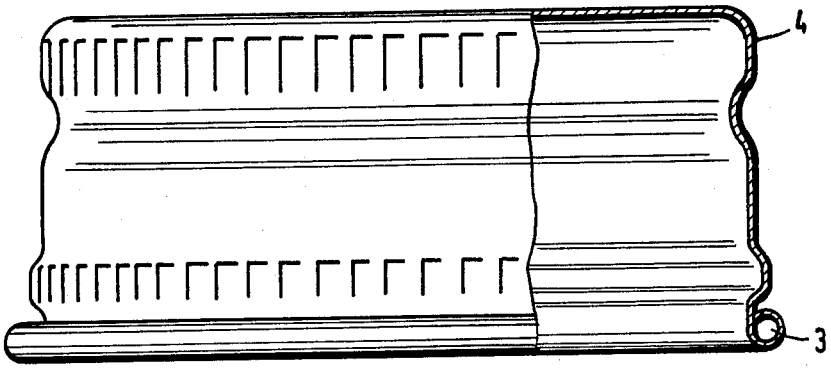
FIG. 1 is a front view partially in section of a conventional metal cap which can be used with the present invention.

FIG. 1 shows a metal cap 4 prior to its application to a bottle (for example). The cap can be easily fabricated since no special sealing surfaces are included. Cap 4 includes a rolled rim 3 at its lower edge.

Figure 2:
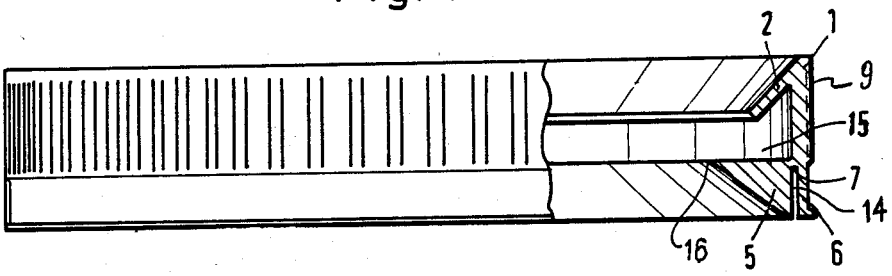
FIG. 2 is a front view partially in section of a sealing ring in accordance with a preferred embodiment of the invention.

A plastic sealing ring is shown generally at 1 in FIG. 2. Sealing ring 1 comprises a collar 9 integral with an annular stop 6. The top of the collar 9 terminates in a downwardly sloping peripheral lip 2. A wedge-shaped security ring 5 is attached to collar 9 at the junction of the collar 9 and annular stop 6 by a plurality (for example, twelve) of fracturable retaining bridges 7. Ring 5 includes a vertical wall 14 displaced slightly from the interior surface of annular stop 6, horizontal a wall 15 and an inner rim 16 adapted to engage a container as described below. The vertical wall 14 of the security ring is uniformly equidistant from the inner surface of the annular stop 6.

Figure 3:
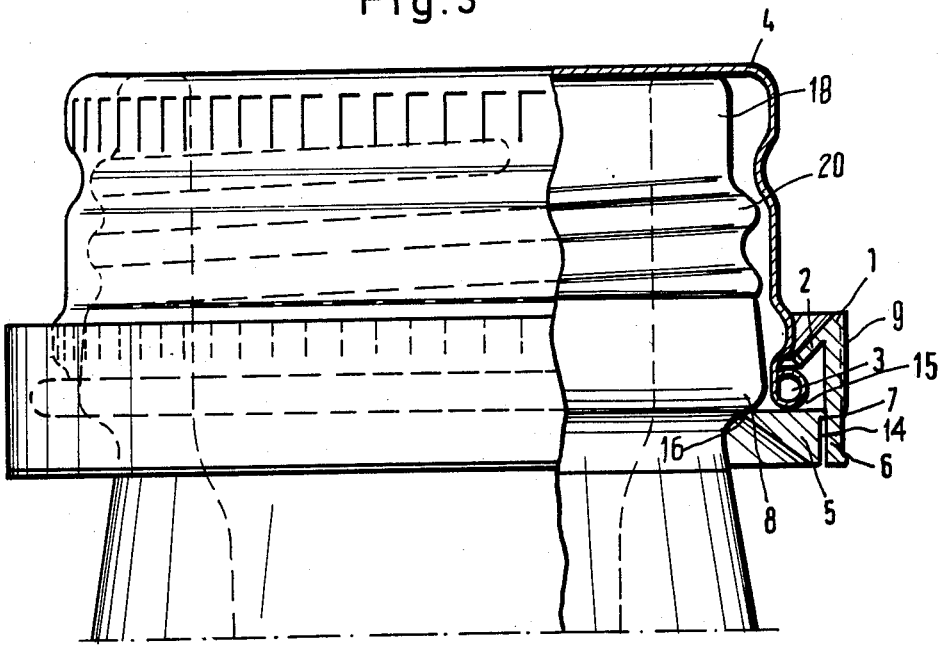
FIG. 3 is a front view partially in section of the closure attached to a bottle.

FIG. 3 shows the closure applied to a bottle 18 which includes threads 20 and an indentation 8 beneath threads 20. To apply the closure, the metal cap 4 is secured to the sealing ring 1 by wedging the rolled rim 3 in the gap between the peripheral lip 2 and the upper horizontal surface 15 of the wedge-shaped security ring 5. This insertion causes no expansion of the sealing ring 1. The assembly is then placed over the neck of bottle 18 until the inner rim 16 of the security ring 5 is snapped into indentation 8 within bottle 18. The metallic cap 4 is then formed by conventional means so that it mates with the threads 20. In FIG. 3 the cap 4 has not been threaded.

The bottle is opened by turning the cap. This motion forces collar 9 upward. The security ring 5 resists the lifting motion because it is anchored against the jar. This results in the ring 5 being pushed outwardly until it contacts the annular stop 6. Since the ring 5 cannot move any further, the continued rotation and raising of the cap forces some or all of the retaining bridges 7 to snap. The cap 4 can now be unscrewed and the sealing ring 5 easily detached from the cap. The resulting metal cap may then be used to recap the bottle or it can be recycled.

A special advantage of this invention is that the opening of this closure generates an optical and acoustical signal. This can alert one to possible illegal tampering with the bottle.

What is claimed is:

1. A closure for sealing threaded bottles, jars, or similar containers, comprising:

(a) a circular plastic sealing ring, comprising a collar having a downwardly extending annular stop integrally formed with said collar, an inwardly protruding peripheral lip extending from the upper portion of said collar, and a security ring having a diameter smaller than that of said collar and attached to the inner surface of said collar by a plurality of fracturable retaining bridges, said annular stop limiting the outward movement of said security ring; and (b) a metallic cap including a rolled rim retained in the gap between said security ring and said peripheral lip.

2. The closure of claim 1 wherein said security ring is wedged-shaped having an inwardly extending rim and horizontal and vertical surfaces, the intersection of which forms a right angle.

3. The closure of claim 2 wherein the vertical surface of said security ring is uniformly equidistant from the inner surface of said annular stop.

4. The closure of claim 3 wherein the number of said retaining bridges and the thickness of said retaining bridges is such that all of such bridges are ruptured upon removal of the cap.

* * * * *